US009175809B2

(12) United States Patent
Kowoll

(10) Patent No.: US 9,175,809 B2
(45) Date of Patent: Nov. 3, 2015

(54) WATER DISTRIBUTION SYSTEM IN A GASIFICATION REACTOR

(75) Inventor: Johannes Kowoll, Bochum (DE)

(73) Assignee: THYSSENKRUPP UHDE GMBH, Dortmund (DE)

( * ) Notice: Subject to any disclaimer, the term of this patent is extended or adjusted under 35 U.S.C. 154(b) by 551 days.

(21) Appl. No.: 13/581,593

(22) PCT Filed: Feb. 23, 2011

(86) PCT No.: PCT/EP2011/000863

§ 371 (c)(1),
(2), (4) Date: Nov. 1, 2012

(87) PCT Pub. No.: WO2011/107228

PCT Pub. Date: Sep. 9, 2011

(65) Prior Publication Data

US 2013/0118587 A1 May 16, 2013

(30) Foreign Application Priority Data

Mar. 1, 2010 (DE) ..... 10 2010 009 721

(51) Int. Cl.

| | |
|---|---|
| ***C10J 3/76*** | (2006.01) |
| ***F17D 1/08*** | (2006.01) |
| ***C10J 3/52*** | (2006.01) |
| ***C10J 3/84*** | (2006.01) |

(52) U.S. Cl.

CPC . *F17D 1/08* (2013.01); *C10J 3/526* (2013.01); *C10J 3/76* (2013.01); *C10J 3/845* (2013.01); *C10J 2200/152* (2013.01); *Y10T 137/0318* (2015.04); *Y10T 137/8593* (2015.04)

(58) Field of Classification Search

CPC ..... C10J 3/76; C10J 3/526; C10J 3/846; C10J 2200/152; F17D 1/08

See application file for complete search history.

(56) References Cited

U.S. PATENT DOCUMENTS

| | | | | |
|---|---|---|---|---|
| 4,474,584 | A | 10/1984 | Koog | |
| 5,976,203 | A * | 11/1999 | Deeke et al. | 48/62 R |
| 2007/0119577 | A1 | 5/2007 | Kraft et al. | |
| 2008/0172941 | A1 * | 7/2008 | Jancker et al. | 48/73 |
| 2008/0222955 | A1 * | 9/2008 | Jancker et al. | 48/67 |
| 2009/0047193 | A1 | 2/2009 | Corry et al. | |

(Continued)

FOREIGN PATENT DOCUMENTS

| | | |
|---|---|---|
| WO | 2009/036985 A1 | 3/2009 |
| WO | 2009036985 | 3/2009 |

OTHER PUBLICATIONS

Taiwanese Office Action, dated Jan. 21, 2015 (No English Translation available), 6 pages attached.

(Continued)

*Primary Examiner* — Matthew Merkling

(74) *Attorney, Agent, or Firm* — Brooks Kushman P.C.

(57) ABSTRACT

A water distribution system in a gasification reactor for carrying out a slag-forming entrained flow process is disclosed having a water screen as a water distribution system with a concentric annular distributor used in conjunction with an axially symmetrical deflecting surface having a concavely curved cross-section. The annular distributor has a water intake and the annular distributor has openings for water to be discharged in jets directed onto the inside of the concavely curved deflecting surface. The water leaving the deflecting surface is conducted downward into the interior of the reactor.

9 Claims, 7 Drawing Sheets

(56) References Cited

U.S. PATENT DOCUMENTS

Figure 1:
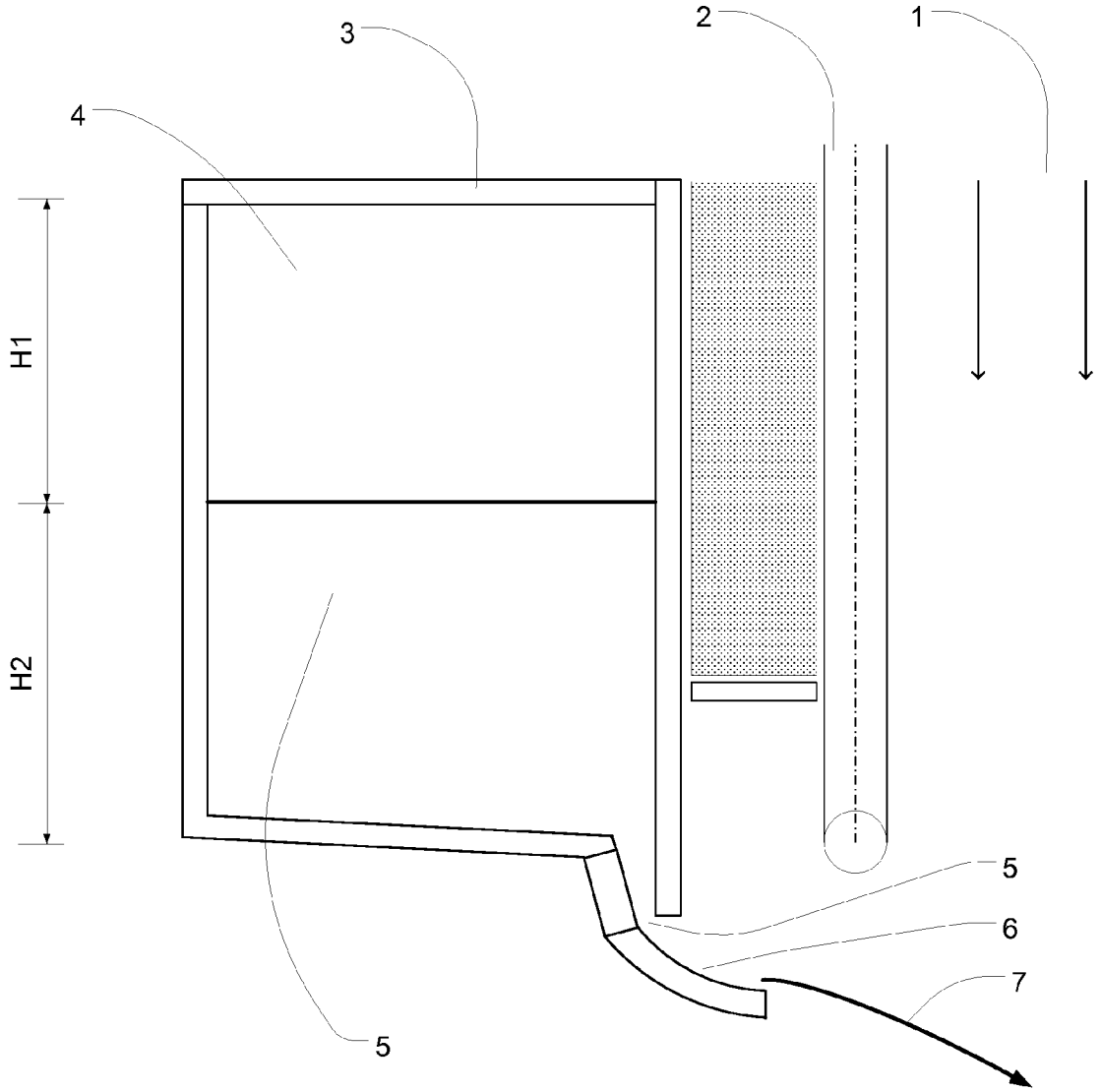

| | | | | |
|---|---|---|---|---|
| 2010/0129270 | A1* | 5/2010 | Roe et al. | 422/171 |
| 2010/0139581 | A1* | 6/2010 | Ebner et al. | 122/7 R |
| 2010/0263278 | A1 | 10/2010 | Kowoll et al. | |
| 2012/0102835 | A1* | 5/2012 | Corry et al. | 48/87 |

OTHER PUBLICATIONS

International Search Report for PCT/EP2011/000863, English translation attached to original, Both completed by the European Patent Office on Nov. 1, 2011, All together 4 Pages.

* cited by examiner

WATER DISTRIBUTION SYSTEM IN A GASIFICATION REACTOR

CROSS-REFERENCE TO RELATED APPLICATION

This application is the U.S. national phase of PCT Appin. No. PCT/EP2011/000863 filed on Feb. 23, 2011, which claims priority to German Patent Application No. 10 2010 009 721.7 filed on Mar. 1, 2010, the disclosures of which are incorporated in their entirety by reference herein.

The invention relates to a water distribution system and a water distribution process for a gasification reactor to perform a slag-forming entrained-flow process in which the generated synthesis gas streams downwardly during the gasification reaction. In processes of this kind, a hot gas having a temperature of 1200 to 2000° C., containing molten and sticky ash particles as well as condensing or desubliming substances, e.g. sodium, potassium, lead and zinc, is generated. These particles may form deposits at cooled walls and cause operational interferences.

To prevent such events, the hot gas is often cooled, i.e. quenched, by mixing it with water, whereby the ash particles quickly solidify. However, fine flue ash particles have features similar to those of cement and in combination with water they may form concrete-like deposits. To prevent such an occurrence, all walls of the quench chamber should continuously be kept either hot and dry or be covered with a water film.

According to prior art in technology, e.g. prior art as described in WO 2009/036985 A1, a gasification reactor of this kind therefore comprises a first reaction chamber arranged at the top in the reactor, in the upper area of which a feeder device for feedstock materials is arranged, and the side walls of which are provided with tubes with interior cooling as a membrane wall or with tube coils at which liquid slag can freely flow off without causing the surface of this slag to solidify, and at the underside of which an opening is provided with a drip-off edge. Furthermore, said gasification reactor is comprised of a second chamber arranged at the bottom in continuation of the opening in which the synthesis gas is kept dry and cooled by radiation cooling and in which a water distribution system is provided for to generate a funnel-shaped water curtain, there being arranged a third chamber at the bottom in continuation of the second chamber and wherein a discharge device for synthesis gas from the reactor is provided for at the bottom or at the side of the third chamber.

To prevent a backflow of generated synthesis gas, the water curtain should not have any gaps or voids in the marginal area. But it should not cool-off so much that it clogs the slag outlet. Besides, the water curtain should be evenly spread across the circumference and be as fine and thin as possible. Furthermore, the generated gas jet to be quenched should be centered so that the hot gas can be quenched as efficiently as possible in the central area of the cross-section after disintregation of the water curtain.

It would also be very advantageous if recycled water could be utilized to produce the water curtain, considering that the slag water utilized for ash cooling on gasification partly contains sharp-edged particles. To avoid severe erosion, it is necessary to maintain low flow velocities, e.g. 2 m/s, in pipelines, distributors, and jet nozzles, whereas deposits are formed at too low velocities, typically at velocities under 0.5 m/s.

A major problem is posed by the requirements exacted in regard to operational safety of the equipment by means of which such a water curtain is to be produced. This concerns, in particular, the annular distributor, but also the ramp described in WO 2009/036985 A1. Inasmuch as recycled water is to be utilized, there still is the problem of permanently keeping clean the water outlet ports from which water is to be evenly distributed onto the ram, no matter whether these ports are slots or bores or jet nozzles, as well as the problem of permanently keeping the ramp clear and free from deposits. Here it should be considered that these plant units are only difficult to access.

To supply a liquid to several jet nozzles, usual pipelines or annular distributors having a constant cross-section are applied in most cases. U.S. Pat. No. 4,474,584 describes a water quench system comprised of several water distributors which comprise a host of jet nozzles. The exemplary illustrations show peripherally extending channels which either have a quadratic or a round cross-section with a constant cross-sectional area.

In distributors of this kind, the velocity falls after each jet nozzle, thus causing the static pressure to increase so that the throughput of the liquid through the jet nozzles varies. With a conventional distributor, however, this leads to substantial unevenness in water distribution. A nearly well balanced water distribution across the circumference can be achieved by increasing the velocity in the jet nozzles, so that the pressure loss in the jet nozzles is markedly higher than the dynamic pressure of the water in the distributor, to be true. But along with an increased velocity, the erosion of the wall material when applied in an entrained-flow gasification reactor would increase beyond the tolerable range.

Now, therefore, it is the object of the present invention to provide an improved water distribution system and an improved water distribution process for a gasification reactor to perform a slag-forming entrained-flow process that does not have the disadvantages outlined hereinabove and that can be installed and operated as economically as possible.

The invention solves this task by means of a water distribution system in a gasification reactor to perform a slag-forming entrained-flow process in which the generated synthesis gas streams downwardly during the gasification reaction, said gasification reactor comprising

- a first reaction chamber arranged at the top in the reactor, in the upper area of which a feeder device for feedstock materials is arranged, and the side walls of which are provided with tubes with interior cooling as a membrane wall or with tube coils at which liquid slag can freely flow off without causing the surface of this slag to solidify, and at the underside of which an opening with a drip-off edge is provided for,
- a second chamber is located at the bottom in continuation of said opening, in which chamber the synthesis gas is kept dry and cooled by radiation cooling, and wherein a water distribution system to produce a funnel-shaped water curtain is provided for,
- a third chamber located in continuation of the second chamber, and there being a discharge device for synthesis gas from the reactor being provided at the bottom or at the side of the third chamber,
- providing a concentric annular distributor in combination with an axis-symmetrical deflection surface concavely bent in its cross-section to serve as a water distribution system to form a water curtain, wherein
- said annular distributor having at least one water inflow,
- said annular distributor having apertures being of a design and construction suitable for a jet-like water outflow,
- the direction of the jet from the openings pointing to the inside of the concavely bent deflection surface, the planar orientation of the concavely surface in the direction of the jet from the apertures being so arranged that the direction of jet and the tangential plane of the cross-sectional area are aligned at an acute angle ranging between 0 and 45 degrees towards each other at the point of impact of said jet, and the deflection surface having such a curvature in its cross-section that it has a deflection angle of more than 60 degrees.

In further configurations of the water distribution system, it is provided fort that the openings are designed and constructed as jet nozzles pointing upwardly. The openings may also have a tangential inclination in the direction of the reactor periphery or an inclination towards the center axis of the reactor. Depending on the execution of the jet nozzles, the pulse of the current in the annular distributor can also be utilized to guide the water jets from the openings with a lateral component and not only vertically from the openings towards the deflection surface.

In a further configuration of the water distribution system, it is provided for that the annular distributor is designed and built with different flow cross-sections which taper from the feed of the annular distributor to each of these openings. Care should be taken to ensure that a flow velocity of approx. 2 m/s, if possible, is maintained. Inasmuch as slag water or other feedback water burdened with particles is to be utilized for the water curtain, the flow velocity in any case must amount to more than 0.5 m/s so that no particles may deposit and settle down. To take account of the risk of erosion, a flow velocity of 3 m/s should not be exceeded. The thickness of the produced water curtain should range between 1 and 10 mm. The flow cross-sections of the annular distributor shall be properly designed by an expert.

In further configurations of the water distribution system, it is provided for that the curvature radius of the deflection surface amounts to less than 0.3 meter. Deflection surfaces of this kind, for example, can be economically obtained from bent tubes open at their longitudinal side. For ease of maintenance, the inventive concave deflection surface can be composed without any problems from section-wise stitched sections or from sections slid into each other.

In further configurations of the water distribution system, it is provided for that a straight section is arranged in continuation of the curvature of the deflection surface. Constructively this can be achieved if the segment for the outlet of the water curtain is not taken out but upwardly bent and straightened after having cut it up on the longitudinal side, thus obtaining a baseball cap-like cross-section for the concave deflection surface.

Like the cooled walls of the quench chamber, the inventive annular distributor on its outside tends to be subjected to deposits of caked material growing there from the gas burdened with particles. Therefore, such cooled walls are usually provided with a water film. The water distribution system can also be so modified by a further development of the annular distributor so that the production of the water films required fort the quench chamber walls and for the exterior wall of the annular distributor itself is equally accomplished. Accordingly, further lateral openings and deflection surfaces lying opposite to them are provided for, producing a water film which adheres to the exterior wall of the annular distributor and furthermore to the wall of the quench chamber and flows down there.

The invention also solves this task by means of a process for water distribution in a gasification reactor on performing a slag-forming entrained-flow process in which the generated synthesis gas streams downwardly during the gasification reaction, and in which a funnel-shaped water curtain closed at the margin is produced, whereby the water is passed in pressurized state into an annular distributor which it quickly flows through until it leaves the annular distributor through apertures, a water jet hitting on a deflection surface is formed as the water leaves through the apertures, each of the water jets is diverged as it glides along the deflection surface and combines with the water jet of the adjacent opening to form a closed water film, this closed water film is passed downwardly into the interior of the reactor after it has left the deflection surface.

On configuring the geometry of the water curtain, the expert in charge thereof should assess which geometric shape to choose for the relevant purpose. If the water curtain is intended to converge in the center of the central channel so that the water curtain is disintegrated predominantly in the central area, the water shall be directed vertically without any swirl against the deflection surface. However, if the falling water curtain is intended to initially contract in the center, but then to expand again during its further fall, and if a more uniform radial distribution of the drops is also desired in order to moisten the marginal areas of the reactor in the lower section of the water curtain, then the water curtain shall be imposed with an appropriate rotation around the reactor axis. In an embodiment of the inventive process, it is therefore provided for that the water jets are so directed in inclined form onto the deflection surface in the circumferential direction of the reactor that the closed water film executes a rotation around the reactor axis.

In a further embodiment of the inventive process, it is provided for that at least another water film is generated via lateral openings and deflection surfaces lying opposite to these openings, said water film adhering to cooled walls of the annular distributor or quench chamber which are exposed to generated gas.

In another embodiment of the inventive process, it is provided for that the water used is the solid-burdened water from the slag bath of the gasification reactor or the water from a water circulation arranged downstream of the slag bath of the gasification reactor. Prior to its use, merely a coarse separation of major slag particles is required, for example in a hydrocyclone.

Figure 2:
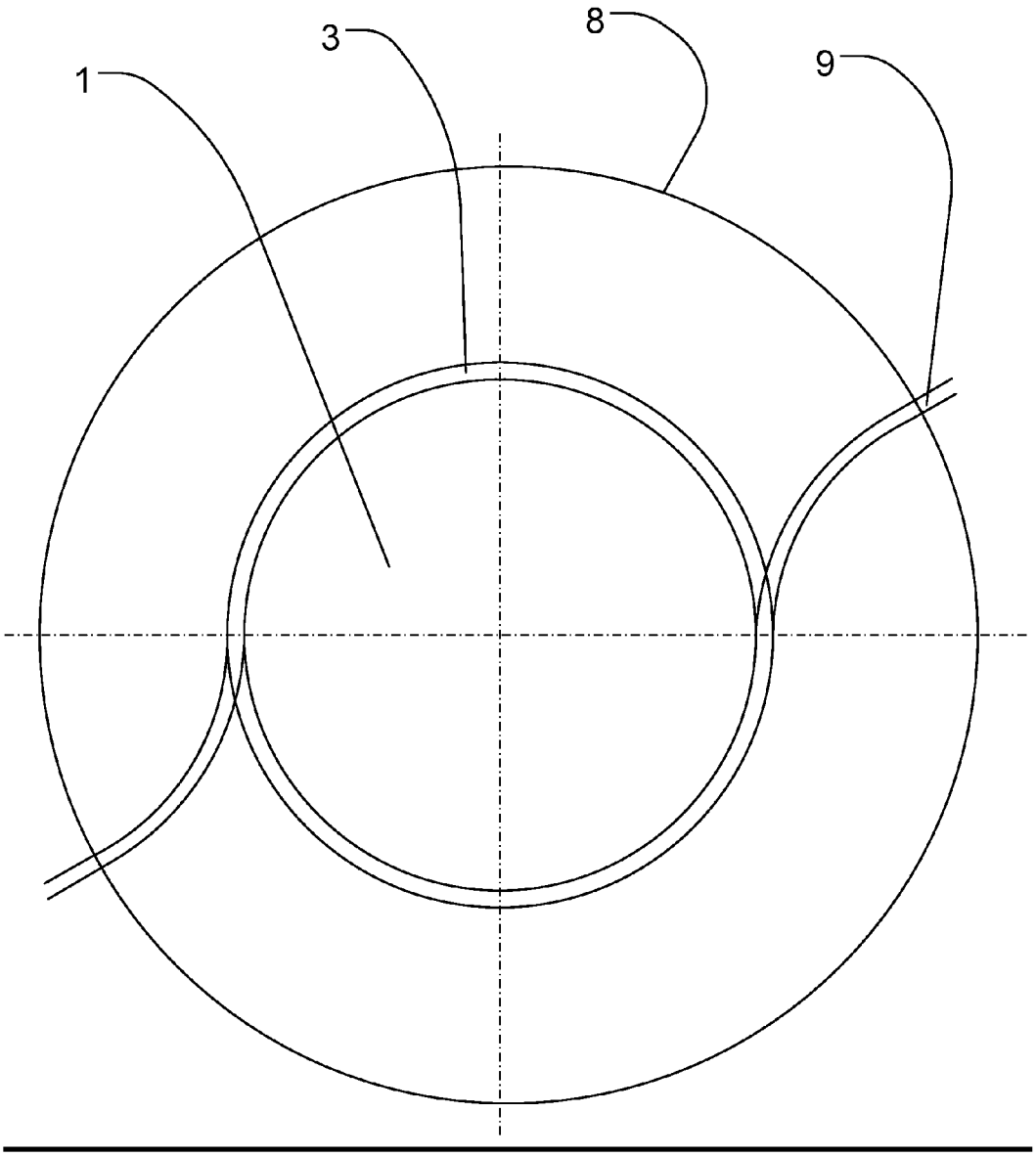
Figure 3:
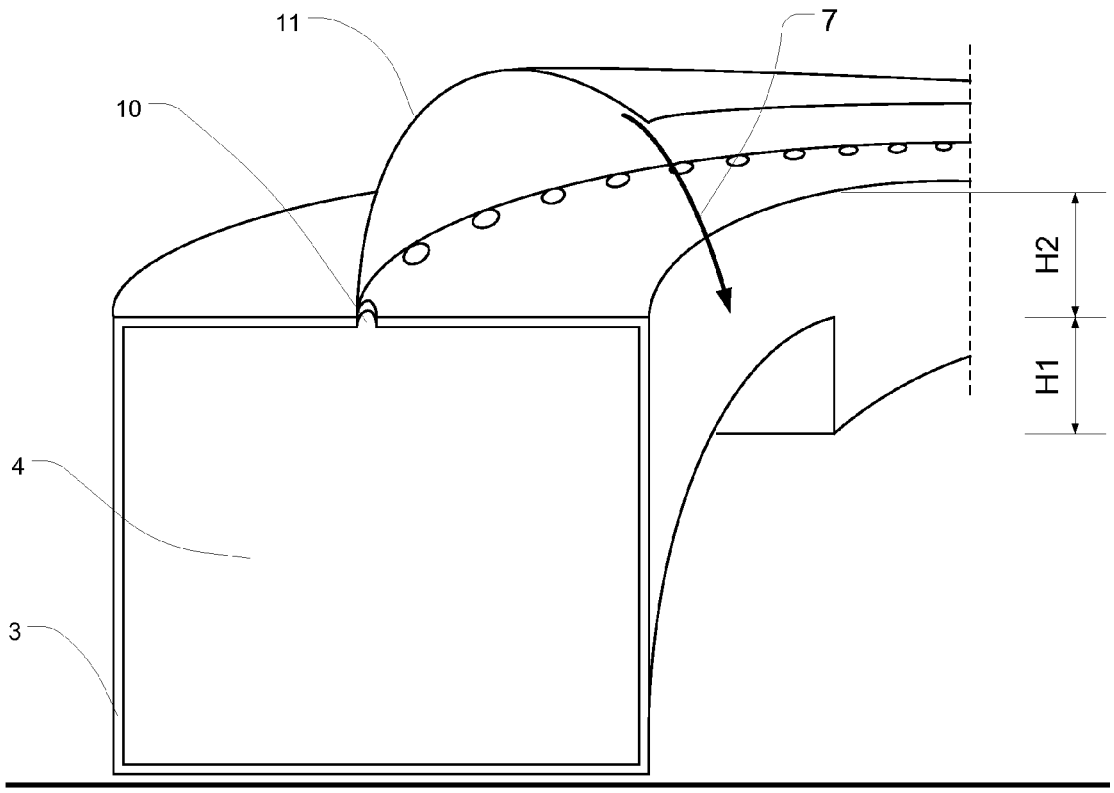
Figure 4:
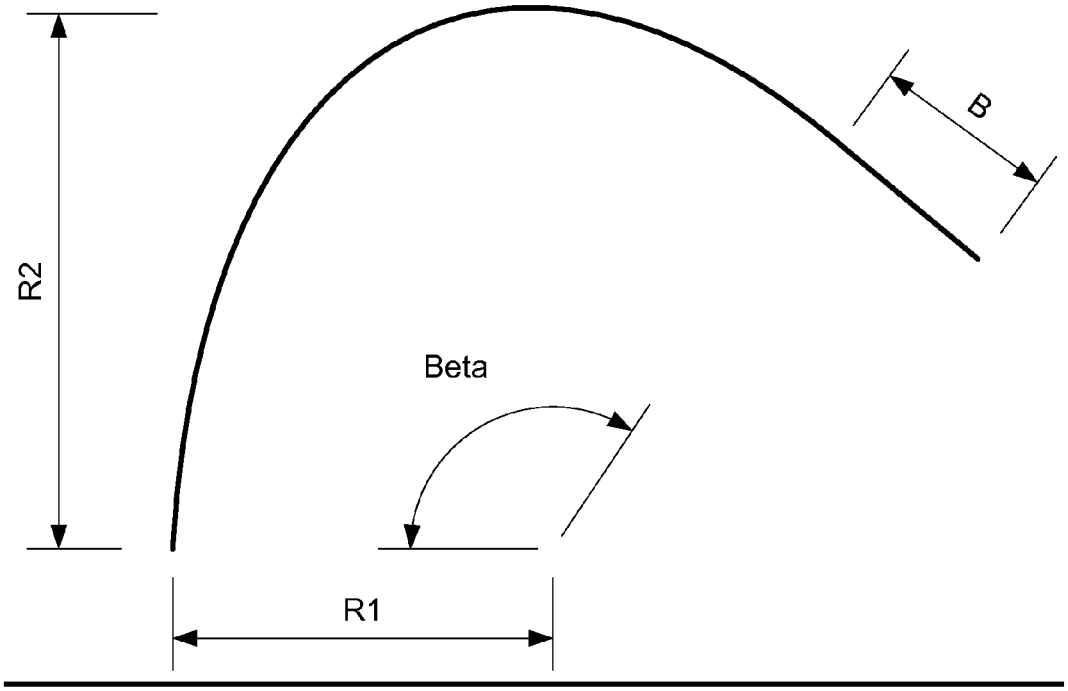
Figure 5:
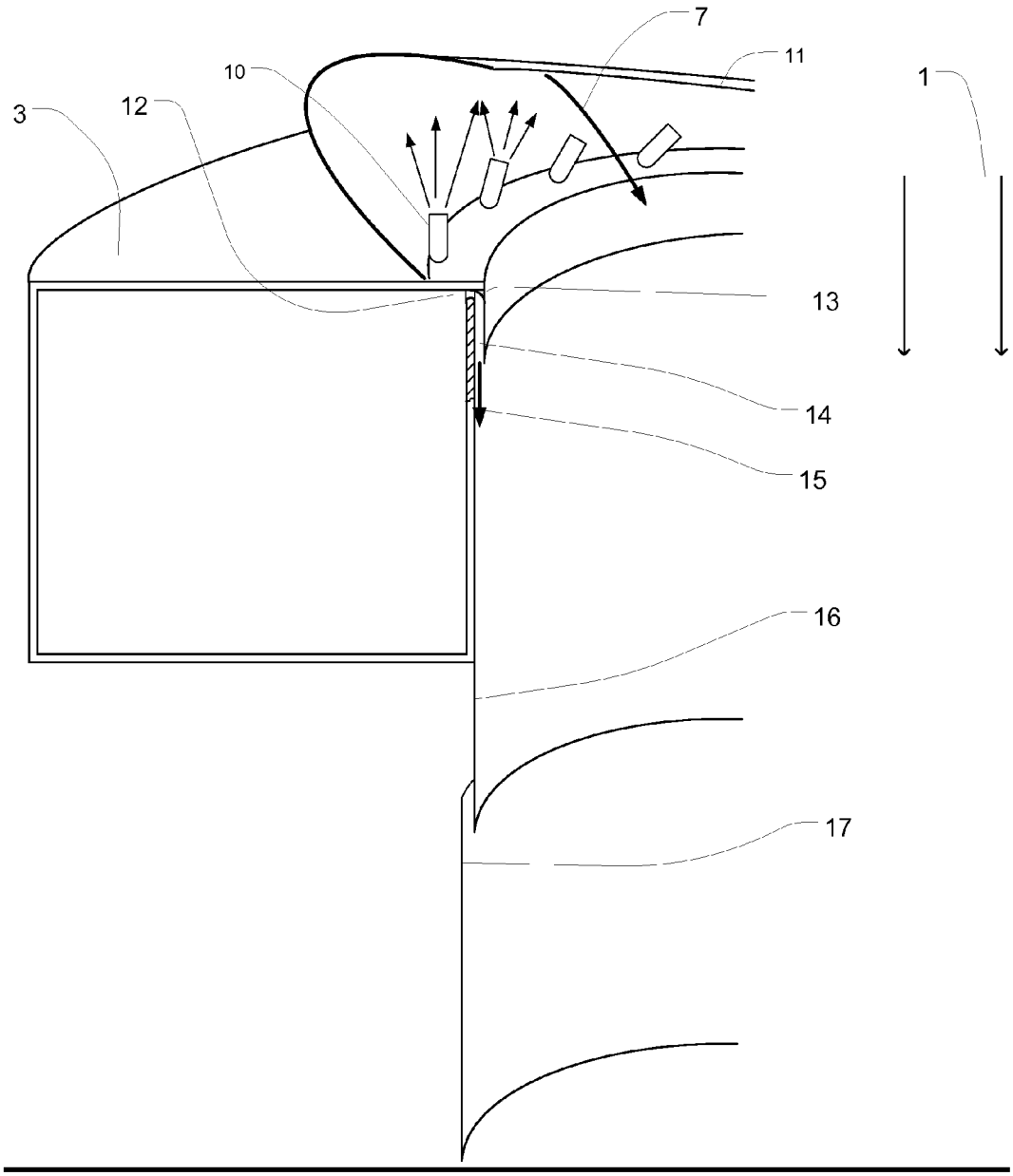
Figure 6:
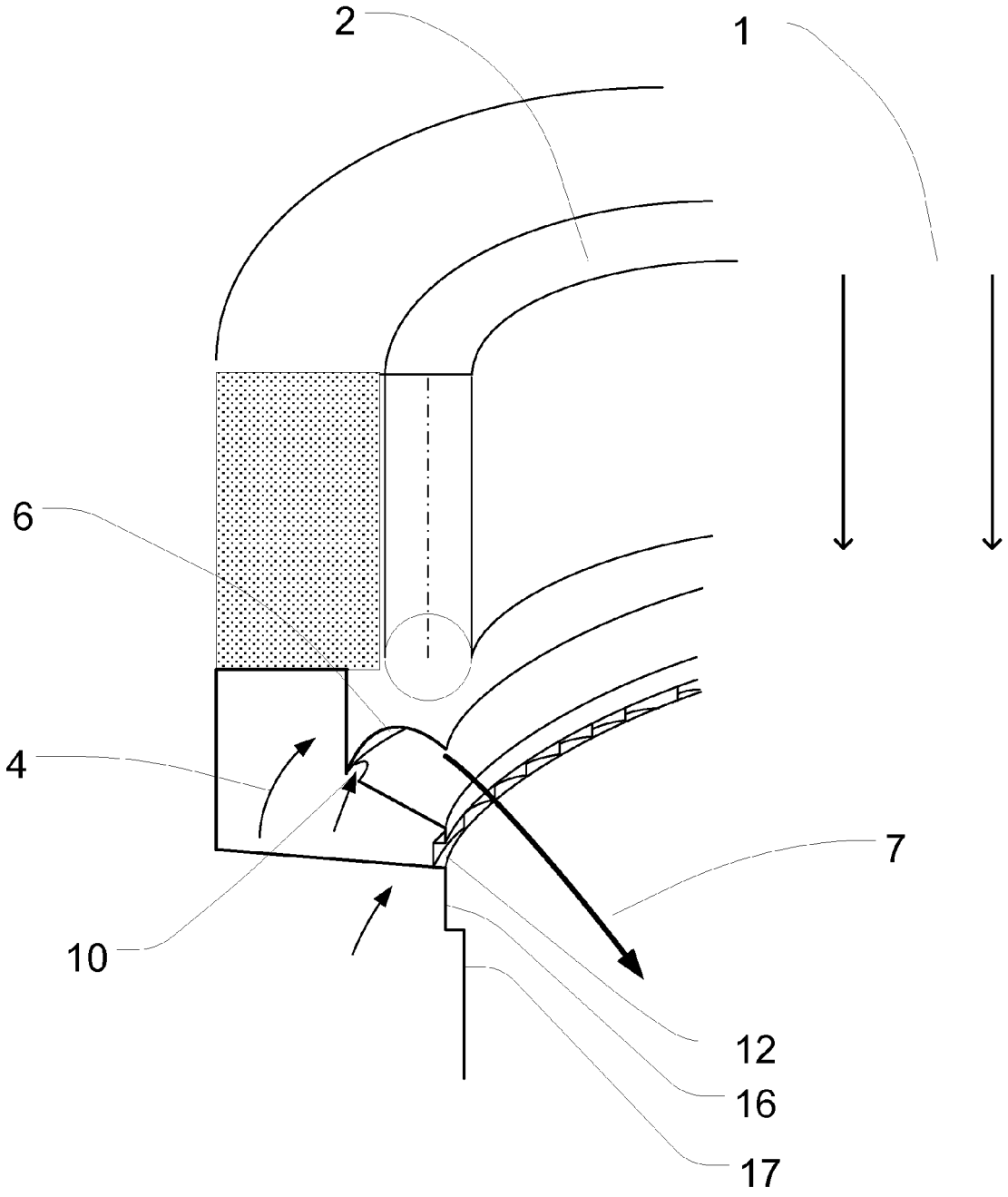
Figure 7:
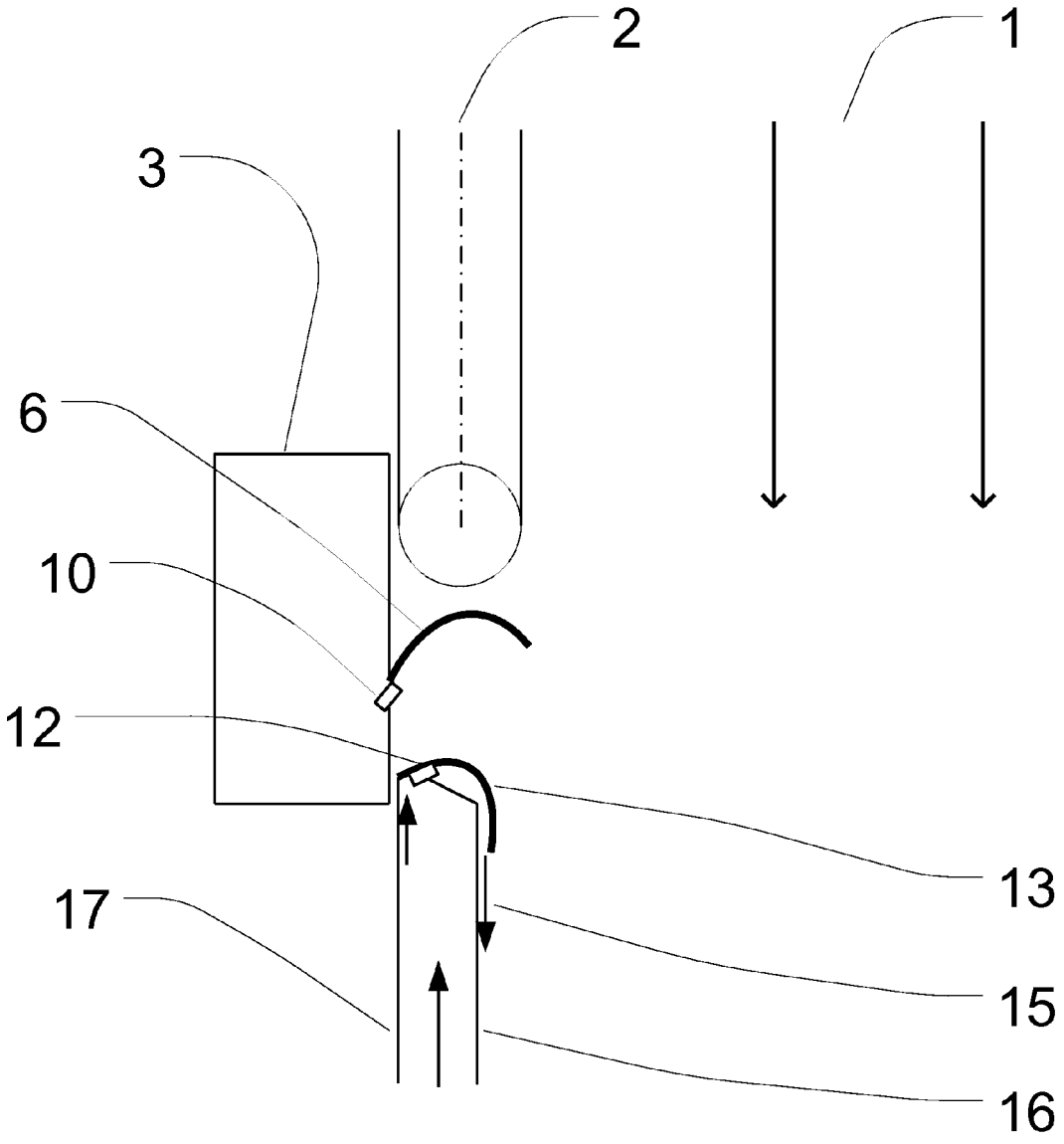

The invention is hereinafter outlined in exemplary form on the basis of 6 sketches. Shown here are in:

FIG. 1: a cross-section of a water distribution system to produce a water curtain with a gap and a curved area to homogenize the flat steel, FIG. 2: a top view on the situation of the water distribution system in the gasification reactor, FIG. 3: a perspective view from an annular distributor with deflection surface, FIG. 4: an advantageous geometry of a deflection surface 11, FIG. 5: an embodiment of the annular distributor 3 with jet nozzles as openings 10 and a device to produce another water film, FIG. 6: another embodiment of the inventive water distribution system, FIG. 7 another embodiment of the inventive water distribution system, FIG. 1 shows a cross-section of the device for the production of the free-falling funnel-shaped water curtain closed at the margin and having a gap according to prior art in technology, extended by a curved area to homogenize the flat steel. The device is located behind a cooled wall 2, which for example is comprised of evaporator tubes. The hot gas 1 streaming out from a gasifier has a temperature ranging between 1000 and 2000° C., and it is comprised of fly ash and molten slag particles. Coarse slag is also obtained in the central area of the usually cylindrical channel 1, the diameter of which lies in a range from 0.6 to 3 m.

The water is fed-in at one or several spots into the peripheral channel 4 of distributor 3 which is comprised of the rectangular upper part and a chamfered bottom. The channel has a constant width across the circumference, but its height varies so that a constant flow velocity in the interior prevails on the entire circumference. Only a part of the cross-section, designated as height H1, is varied, whereas the remaining part of the cross-section has a function similar to the function of a flywheel in order to offset effects resulting from disturbances in the entrance area and effects resulting from deviations of the structure from the arithmetically ideal form.

The water leaves the distributor through the outlet gap 5 and subsequently it is deflected on the deflection 6 designed and constructed as a concave area. If small sections of the cross-section of the outlet gap 5 are clogged, the water jet streaming out has voids. But on the curved area, the water is pressed so vigorously against the concave area that these voids are closed. Produced from the water film of the deflection 6 designed and built as a ramp is initially a closed water curtain 7 which falls freely and which decomposes only as a result of mixing it with the hot gas 1. The closed water curtain prevents an upward stream of the cooled gas containing water drops into the gasifier outlet area, whereby interferences in the slag discharge are prevented.

The disadvantage with this way of producing a water curtain lies in that the water contains solid substances which may clog a 1 to 10 mm wide gap more and more, whereby the produced water curtain would have voids despite the curvature, at least if the water curtain is in most cases intended to be only a few millimeters thick. For reasons of operational safety, it means in practice that the water curtain would have to be constructed in a thickness higher than required in terms of process engineering, or that the water to be used would have to be cleaned from particles at substantial expenditure before its use, if not even the use of fresh water would be required. However, this disadvantage can be avoided by providing several wider openings spread on the circumference instead of one narrow peripheral gap, with the jets streaming out being pressed flat on the concave deflection 6 due to the centrifugal force and forming a closed film.

FIG. 2 shows a top view on the situation of the water distribution system in the gasification reactor, with the pressure vessel 8, the feeder mains 9 for feeding water into the annular distributor 3, and the central cylindrical channel with hot gas 1. A water feed via one feeder main only would also be feasible. In that case, the annular distributor would have to have an appropriately larger diameter. Though a larger feeder main is less costly than several smaller feeder mains, it is also stiffer which may cause thermal expansion differences between distributor 3 and pressure vessel 8. Concerning the number of feeder mains, the expert in charge should find the relevant optimum.

FIG. 3 shows a perspective clip from an annular distributor 3 with the deflection surface 11. The inventive production of the water curtain 7 is accomplished by means of clearly larger openings 10 which cannot be clogged, and by means of a deflection surface 11 onto which the water jets streaming-out are flat pressed by way of centrifugal forces and form a flat water curtain 7 when they leave the system.

To ensure equal transverse velocity in the incident flow at all openings, a largely constant circumferential velocity of the water stream in annular distributor 3 is required, which can be achieved by varying the cross-section; in the present example this is accomplished by varying the height, but it is also possible to utilize other variation possibilities. The inflow of water is effected on the transverse area next to the inscription H1. H1 represents the variable part of the height, whereas H2 represents the constant part of the overall height which is additively composed of H1 and H2. As shown in FIG. 3, the openings can be executed as round bores, but also as rectangular slots or as straight and/or bent jet nozzles.

If it is intended to twist the water curtain in circumferential direction, the pulse of the circumferential stream in the annular distributor 3 can be utilized for this purpose. It is sufficient to configure the openings 10 in such a manner that the circumferential component of the pulse is not destroyed when the water leaves through the openings 10. If the upper wall of the annular distributor 3 is clearly thinner than the length of the opening in circumferential direction, the openings can be fabricated vertically to the wall. With a thicker wall, the openings should be fabricated in oblique form, with the most favorable angle resulting from the nomally-directed and the tangentially-directed velocity components by vector addition.

FIG. 4 shows an advantageous geometry of a deflection surface 11. The deflection surface should mainly have a circular or elliptical form and encompass a deflection angle BETA. Tests have evidenced that the radii R1 and R2 can be varied in a broad range. At the end of the curved part of the deflection surface, a section B which is straight in the longitudinal section is provided for, i.e. a conical section in 3-dimensional perspective, so that no centrifugal forces at the tear-off edge take an effect on the water and alater the direction of the jet. Only a short "straight" section is required. With a length of 5 to 10 water film thicknesses, which is 10 to 20 mm with a 2 mm thick water film gliding along the deflection surface, a stable, even water curtain is produced.

FIG. 5 shows an embodiment of the annular distributor 3 with jet nozzles as openings 10. Water from the annular distributor 3 streams-out through jet nozzles which are inclined into the tangential direction. The deflection surface 11 can at first be inclined outwardly in order to achieve greater peripheral angles and to cause a prolongation of the way on which the water jets are pressed flat due to the centrifugal forces.

Furthermore, FIG. 5 shows the production of a water film 15 which flows off at the annular distributor 3 on the side facing the reactor chamber, thus protecting it from deposits of caked material. In the cylindrical inner wall of the annular distributor 3, openings 12 are therefore provided through which part of the water circulating in the distributor streams into a gap 14, which for example is formed by the inner wall of the annular distributor and a cylindrical plate 13 which is curved at the upper end so that the water jets shaped through the openings 12 are pressed flat and form a thin film at first on surface 13. The openings 12 may have shapes similar to those of openings 10, i.e. bores, slots or jet nozzles.

The circumferential velocity should be maintained with the through-flow so that the film formed on surface 13 is hurled against the wall 16 still within gap 14 due to the centrifugal force. With low film thicknesses, the width of the gap 14 may be greater than that of the water film. The deflection surface at the upper end of plate 13 should have a very small radius, e.g. 30 mm. The diameter of openings 12 and the width of gap 14 may be substantially greater than the thickness of the produced wall film so that coarser, e.g. 10 mm large, slag grains can pass through this device unrestrictedly with the water.

A design example for an embodiment according to FIG. 5 should further elucidate the functional mode: A funnel-shaped free-falling water curtain having the following initial parameters is to be produced:

diameter 1 m,
velocity 1.5-2 m/s,
thickness 2 mm

The water contains solid particles which may be up to 5 mm large.

The jet nozzle inner diameter should then be chosen to be 10 mm in order to exclude any clogging. The distance between the jet nozzles is so chosen that the demanded velocity of 1.5 to 2 m/s prevails in the jet nozzles. The jet nozzles should therefore be spaced at a distance of 40 mm from each other. Experimental tests evidence that a flat water curtain can be produced already at centrifugal forces above 10 $m/s^2$ if the jet nozzles are accommodated closely side by side. The smaller the radius, the higher are the centrifugal forces and the greater is the admissible distance and the inner diameter of the jet nozzles. With a 30 mm radius of the deflection plate, a centrifugal acceleration of 75 $m/s^2$ at 1.5 m/s and 133 $m/s^2$ at 2 m/s—which is the 7-fold to 13-fold of the gravitational acceleration—acts on the water. Tests and experiments have shown that an even and flat water curtain is produced under these conditions.

FIG. 6 illustrates another embodiment of the inventive water distribution system. The free-falling water curtain 7 is produced in a manner similar to the one described in FIG. 3 and FIG. 5. The wall film, however, is generated by tangential injection of the water streaming through openings 12 onto the surface 16. The velocity of the water in the openings 12 may be higher than the circumferential velocity of the water in distributor 4, so that the water jets are pressed against the wall 16 and form a flat film. To promote the formation of a homogeneous film, a small e.g. 10 mm wide diameter leap can be additionally provided between surfaces 16 and 17 so that at first a rotating 10 mm thick water layer is formed from which a thinner wall film with an initially low vertical velocity is achieved at the wall 17.

The design is to be elucidated more precisely by way of the following example: A cylindrical wall with a diameter of 2 m shall be protected with a thin water film from deposits, the narrowest cross-sections should be at least 10 mm wide in order to exclude clogging, and with the required normal initial velocity of the free-falling water curtain 7 and thus the normal water outlet velocity in the openings 10 and 12 amounting to approx. 5 m/s.

With a tangential velocity of 5 m/s at the surface 16, a centrifugal acceleration of 25 $m/s^2$ acts on the water streaming out through slots 12, this velocity being markedly higher than the gravitational acceleration, whereby a closed, thin water film adhering on the wall can be produced. The areas with velocities of over 3 m/s should be fabricated from materials that are resistant to erosion, e.g. cast iron or ceramics, or these areas can be coated with metallic parts by means of build-up welding using an appropriate material.

FIG. 7 illustrates another embodiment of the inventive water distribution system. The free-falling water curtain 7 is produced in a manner similar to the one described in FIGS. 3 to 6, and the wall film being produced similarly to FIG. 5. However, the partition wall is comprised of two concentric surfaces 16 and 17 and the water supply for the production of the film 16 and water curtain films 7 is accomplished through the intermediate space. This solution is particularly favorable, if the water is delivered from the slag bath within the pressure vessel by applying suitable pumping means, e.g. injectors, to the openings 10 and 12.

LIST OF REFERENCE NUMBERS

1 Central cylindrical channel with hot gas, 1200-1800° C., up to 80 bar
2 Cooled wall
3 Annular distributor
4 Flown-through cross-section of the annular distributor with circulating water
5 Outlet gap
6 Deflection
7 Water curtain
8 Pressure vessel
9 Feeder lines (one or several) of water into the distributor
10 Openings (round, angular, straight/oblique slots) or jet nozzles
11 Deflection plate or form
12 Openings, like 10
13 Annular plate
14 Gap
15 Wall film
16 Cylindrical partition wall
17 Cylindrical partition wall

The invention claimed is:

1. In a water distribution system in a gasification reactor for performing a slag-forming entrained-flow process in which the evolving synthesis gas streams downwardly during the gasification reaction, said gasification reactor being comprised of a first reaction chamber arranged at the top in the reactor, in the upper area of which a feeder device for feedstock material is arranged, and the lateral walls of which are provided with tubes having internal cooling as a membrane wall or with tube coils from which liquid slag can freely flow downwards without causing the surface of this slag to solidify, and at the underside of which an opening with a drip-off edge is provided, a second chamber located at the bottom in continuation of the said opening, in which the synthesis gas is kept dry and cooled by radiation cooling, and wherein a water distribution system for production of a funnel-shaped water curtain is provided, a third chamber located at the bottom in continuation of the second chamber, and that a discharge device for synthesis gas from the reactor is installed at the bottom or on the side of the third chamber, wherein the improvement comprises:

providing, as the water distribution system, a concentric annular distributor in combination with an axis-symmetrical deflection surface concavely curved in its cross-section, wherein the annular distributor has at least one water feed, the annular distributor has openings which are constructed to permit a jet-like water outlet, the direction of the jet from the openings points to the inside of the concavely curved deflection surface, the planar orientation of the concavely curved surface, in the direction of the jets from the openings, arranged such that the direction of the jet and the tangential plane of the cross-sectional area are aligned to each other at the point of impact of the jet at an acute angle ranging between 0 and 45 degrees, and wherein the deflection surface in its cross-section is curved such that it has a deflection angle (BETA) of more than 60 degrees.

2. The water distribution system of claim 1, wherein the openings are constructed as upwardly directed jet nozzles.

3. The water distribution system of claim 2, wherein the upwardly directed jet nozzles have a tangential inclination in the direction of the reactor circumference.

4. The water distribution system of claim 2, wherein the upwardly directed jet nozzles have an inclination towards the center axis of the reactor.

5. The water distribution system of claim 1, wherein the annular distributor is constructed with different flow cross-sections which taper from the inflow of the annular distributor towards each of the openings.

6. The water distribution system of claim 1, wherein the curvature radius of the deflection surface amounts to less than 0.3 meter.

7. The water distribution system of claim 1, wherein the concave surface is composed of sections stitched to each other.

8. The water distribution system of claim 1, wherein a straight section follows in continuation of the curvature of the deflection surface.

9. The water distribution system of claim 1, wherein further lateral openings and deflection surfaces lying opposite to them are further provided at the annular distributor.

* * * * *